US006866766B2

(12) United States Patent
LaCamera et al.

(10) Patent No.: US 6,866,766 B2
(45) Date of Patent: Mar. 15, 2005

(54) METHODS AND APPARATUS FOR REDUCING SULFUR IMPURITIES AND IMPROVING CURRENT EFFICIENCIES OF INERT ANODE ALUMINUM PRODUCTION CELLS

(75) Inventors: Alfred F. LaCamera, Trafford, PA (US); Siba P. Ray, Murrysville, PA (US); Xinghua Liu, Murrysville, PA (US); Robert L. Kozarek, Apollo, PA (US); Jerry L. Roddy, Knoxville, TN (US)

(73) Assignee: Alcoa Inc., Pittsburgh, PA (US)

( * ) Notice: Subject to any disclaimer, the term of this patent is extended or adjusted under 35 U.S.C. 154(b) by 185 days.

(21) Appl. No.: 10/212,442

(22) Filed: Aug. 5, 2002

(65) Prior Publication Data

US 2004/0020786 A1 Feb. 5, 2004

(51) Int. Cl.[7] ..... C25C 3/06; C25C 3/08
(52) U.S. Cl. ..... 205/372; 205/380; 205/393
(58) Field of Search ..... 205/393, 372, 205/380

(56) References Cited

U.S. PATENT DOCUMENTS

| | | | | |
|---|---|---|---|---|
| 4,087,339 A | * | 5/1978 | Elliott et al. | 205/588 |
| 4,330,380 A | * | 5/1982 | Parkinson et al. | 205/557 |
| 4,500,401 A | * | 2/1985 | Clark et al. | 205/336 |
| 5,227,045 A | * | 7/1993 | Townsend | 205/230 |
| 5,415,742 A | * | 5/1995 | La Camera et al. | 205/336 |
| 5,794,112 A | | 8/1998 | Ray et al. | |
| 5,865,980 A | | 2/1999 | Ray et al. | |
| 6,126,799 A | | 10/2000 | Ray et al. | |
| 6,162,334 A | | 12/2000 | Ray et al. | |
| 6,217,739 B1 | | 4/2001 | Ray et al. | |
| 6,258,247 B1 | | 7/2001 | Brown et al. | |
| 6,332,969 B1 | | 12/2001 | Ray et al. | |
| 6,372,119 B1 | | 4/2002 | Ray et al. | |
| 6,379,512 B1 | | 4/2002 | Brown et al. | |
| 6,416,649 B1 | | 7/2002 | Ray et al. | |
| 6,423,195 B1 | | 7/2002 | Ray et al. | |
| 6,423,204 B1 | | 7/2002 | Ray et al. | |
| 6,485,628 B1 | * | 11/2002 | Brown et al. | 205/381 |
| 6,497,807 B1 | | 12/2002 | Brown et al. | |

FOREIGN PATENT DOCUMENTS

WO WO 99/41431 8/1999

OTHER PUBLICATIONS

Matiasovsky, Kamil, "Impurities in an Aluminum Electrolyte", *Ustav Anorg. Chem.*, Slovakian Akad. Ved., (1974), vol. 1, pp 32–35, no month.

* cited by examiner

*Primary Examiner*—Donald R. Valentine
(74) *Attorney, Agent, or Firm*—Tracey D. Beiriger; Eckert Seamans Cherin & Mellott, LLC

(57) ABSTRACT

Methods and apparatus are disclosed for reducing sulfur impurities in aluminum electrolytic production cells in order to significantly increase current efficiency of the cells. An impurity reduction zone may be created in the bath of an inert anode cell by submerging a purifying electrode in the bath. In another embodiment, an oxygen barrier tube may be disposed in a portion of the bath. In a further embodiment, reductants such as aluminum, CO and/or $CO_2$ are added to the bath. In another embodiment, electrode current is interrupted or electrodes are removed from selected regions of the cell in order to allow gaseous impurities to escape from the bath. Sulfur impurity levels may also be reduced in inert anode cells by scrubbing bath emissions from the cell before they are reintroduced into the cell, and by controlling sulfur impurity contents of materials added to the cell.

53 Claims, 17 Drawing Sheets

METHODS AND APPARATUS FOR REDUCING SULFUR IMPURITIES AND IMPROVING CURRENT EFFICIENCIES OF INERT ANODE ALUMINUM PRODUCTION CELLS

FIELD OF THE INVENTION

The present invention relates to the operation of electrolytic aluminum production cells. More particularly, the invention relates to the reduction of sulfur impurities in inert anode aluminum production cells in order to increase current efficiencies of the cells.

BACKGROUND OF THE INVENTION

Aluminum is conventionally produced in electrolytic reduction cells or smelting pots which include an electrolytic bath comprising molten aluminum fluoride, sodium fluoride and alumina, a cathode, and consumable carbon anodes. The energy and cost efficiency of aluminum smelting can be significantly reduced with the use of inert, non-consumable and dimensionally stable anodes. Replacement of traditional consumable carbon anodes with inert anodes allows a highly productive cell design to be utilized, and may provide environmental benefits because inert anodes produce essentially no $CO_2$ or $CF_4$. Some examples of inert anode compositions are provided in U.S. Pat. Nos. 5,794,112, 5,865,980, 6,126,799, 6,217,739, 6,332,969, 6,372,119, 6,416,649, 6,423,195 and 6,423,204, which are incorporated herein by reference.

During aluminum smelting operations, deleterious impurities such as sulfur, iron, nickel, vanadium, titanium and phosphorous may build up in the electrolytic bath. For example, in inert anode cells, sulfur species can build to higher concentrations in the bath because it is no longer removed as COS or other sulfur-containing species as in consumable carbon anode cells. The presence of sulfur or other multi-valence elemental impurities in the bath causes unwanted redox reactions which consume electrical current without producing aluminum. Such impurities can significantly reduce the current efficiency of the cells. Sulfur species have a high solubility in the bath and act as oxidizing agents to react Al to form $Al_2O_3$. This can cause unwanted back reaction of the aluminum which also reduces the current efficiency of the cell. Furthermore, sulfur, iron, nickel and other impurities in the bath can lower the interfacial energy between the bath and the molten pad of aluminum formed in the cell, thereby reducing coalescence or promoting emulsification of the surface of the aluminum pad.

The present invention has been developed in view of the foregoing, and to address other deficiencies of the prior art.

SUMMARY OF THE INVENTION

The present invention recognizes the build up of sulfur impurities in inert anode aluminum production cells, and reduces such impurities in order to increase current efficiencies of such cells. Sulfur impurities may be reduced and removed in regions of the bath in order to achieve high current efficiencies. Gaseous emissions may be scrubbed prior to dry scrubbing with alumina in order to minimize the recirculation of impurities into the bath while maintaining acceptably low sulfur concentrations. Sulfur content of materials introduced into the bath may be controlled.

An embodiment of the present invention provides impurity reduction zones in the bath of inert anode aluminum production cells which reduce or eliminate unwanted impurities. In one embodiment, the impurity reduction zone is provided by a purifying electrode having an electrochemical potential that is controlled within a selected potential range which reduces or oxidizes sulfur impurities, thereby facilitating removal of the impurities from the bath. For example, reduced sulfur species have much lower bath solubility than oxidized sulfate impurity species, and the reduced sulfur species can escape relatively easily from the bath while avoiding a redox cycle caused by the oxidized sulfate species. In another embodiment, the impurity reduction zone comprises a volume of the bath in which oxygen is reduced or eliminated, e.g., oxygen generated during operation of an inert anode cell is prevented from entering a region of the bath. In a further embodiment, the impurity reduction zone is created through all or portion of the bath by adding a reductant such as Al, carbonates (e.g., Na, Ca, Li, Al and Mg carbonates), CO and/or $CO_2$. In another embodiment, electric current flow is interrupted through some or all of the electrodes of a cell, or electrodes are not positioned in certain areas of the cell, in order to allow sulfur-containing gas to escape from the bath. These embodiments in which impurity reduction zones are provided in the bath may be used alone or in various combinations.

Another embodiment of the present invention removes sulfur impurities from gaseous cell emissions by techniques such as scrubbing with activated carbon to remove $SO_2$ before it is absorbed by the alumina that is returned to the inert anode cell.

A further embodiment of the present invention reduces sulfur impurities to acceptable levels by controlling the sulfur content of materials added to the bath, such as the sulfur content of alumina and aluminum fluoride fed to the bath. Mass balance calculations may be used in order to select acceptable sulfur content of alumina and other materials added to the bath.

An aspect of the present invention is to provide a method of operating an inert anode electrolytic aluminum production cell. The method comprises providing a cell comprising an electrolytic bath, a cathode and at least one inert anode positioned at or above a level of the cathode, passing current between the inert anode and the cathode through the electrolytic bath, and maintaining a sulfur impurity concentration in the electrolytic bath of less than about 500 ppm. In a preferred embodiment, the sulfur impurity concentration is maintained below about 100 ppm.

Another aspect of the present invention is to provide a method of reducing sulfur impurities in an electrolytic aluminum production cell. The method comprises providing an impurity reduction zone within an electrolytic bath of the cell. In a preferred embodiment, the cell comprises inert anodes.

A further aspect of the present invention is to provide a method of producing aluminum. The method includes the steps of providing a cell comprising an electrolytic bath, a cathode and at least one inert anode located at or above a level of the cathode, passing current between the at least one inert anode and the cathode through the electrolytic bath, maintaining a sulfur impurity concentration in the electrolytic bath of less than about 500 ppm, and recovering aluminum from the cell.

Another aspect of the present invention is to provide an inert anode electrolytic aluminum production cell comprising means for reducing sulfur impurities contained in an electrolytic bath of the cell during operation of the cell.

A further aspect of the present invention is to provide an inert anode electrolytic aluminum production cell comprising a cathode, at least one inert anode located at or above a level of the cathode, an electrolytic bath communicating with the cathode and the at least one anode, and a sulfur impurity reduction zone within the electrolytic bath.

Another aspect of the present invention is to provide an inert anode electrolytic aluminum production cell comprising a cathode, at least one inert anode, an electrolytic bath communicating with the cathode and the at least one anode, and a purifying electrode at least partially submerged in the electrolytic bath for providing a sulfur impurity reduction zone within the electrolytic bath.

A further aspect of the present invention is to provide an inert anode electrolytic aluminum production cell comprising a cathode, at least one inert anode, an electrolytic bath communicating with the cathode and anode, and a purifying electrode at least partially submerged in the electrolytic bath for providing an impurity reduction zone within the electrolytic bath.

These and other aspects of the present invention will be more apparent from the following description.

BRIEF DESCRIPTION OF THE DRAWINGS

FIG. 10*a* shows a solidified bath with minimal sulfur impurities in which a coalesced aluminum pad has been formed. FIGS. 10*b*–10*d* show solidified baths containing high levels of sulfur impurities, illustrating the formation of several uncoalesced aluminum spheres throughout the frozen bath.

DETAILED DESCRIPTION OF PREFERRED EMBODIMENTS

Figure 1:
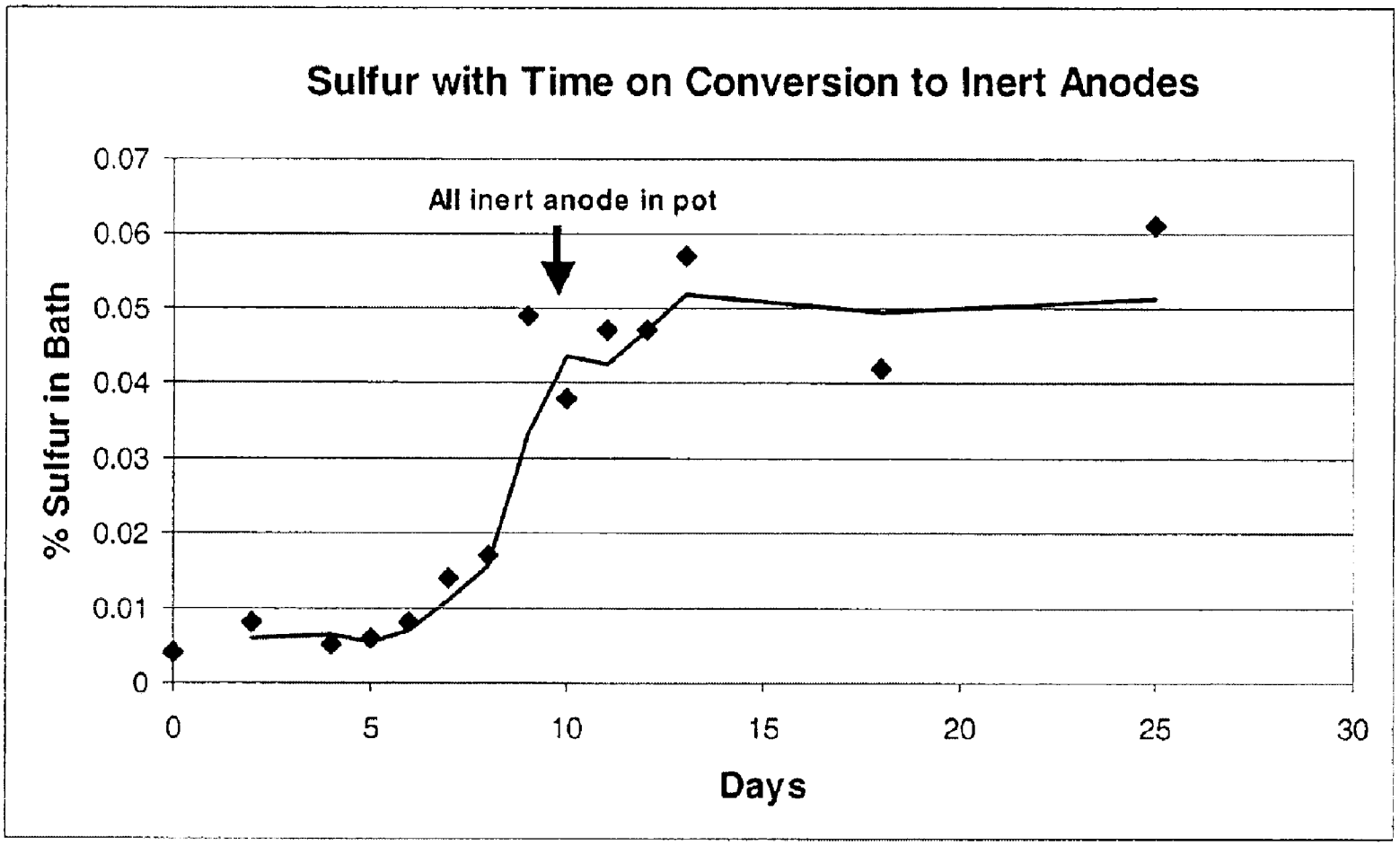
FIG. 1 is a graph illustrating the build up of sulfur impurity levels during operation of an inert anode aluminum production cell.

The present invention reduces sulfur impurities during aluminum smelting processes which have been found to adversely affect current efficiency of the electrolytic cells. Additional types of impurities to be reduced or eliminated include iron, copper, nickel, silicon, zinc, cobalt, vanadium, titanium and phosphorous impurities. The "current efficiency" of a cell can be determined by the amount of aluminum produced by a cell during a given time compared with the theoretical amount of aluminum that could be produced by the cell based upon Faraday's Law.

Sulfur is a particularly harmful impurity which has been found to significantly adversely effect current efficiency of inert anode cells. For example, in inert anode cells, sulfur in ionized forms such as sulfates, e.g., $Na_2SO_4$ and $Na_2SO_3$, may be present in various valence states, e.g., $S^{-2}$, $S^0$, $S^{+2}$, $S^{+4}$ and $S^{+6}$. The $S^{+6}$ species is particularly disadvantageous in inert anode cells because it can be easily reduced and subsequently reoxidized. The sulfur impurities form redox couples between the anodes and cathodes of the cells which consume electricity without producing aluminum. Furthermore, sulfur impurities adversely affect the bath/aluminum interfacial energy such that uncoalesced aluminum is dispersed in the bath where it can be more easily oxidized. Current efficiency is significantly reduced as a result of sulfur impurities. It is therefore desirable to eliminate some or all sulfur species from the bath. It is typically desirable to maintain sulfur impurity levels below about 500 ppm in the bath, preferably below about 250 ppm. In a particularly preferred embodiment, sulfur impurity levels are maintained below about 100 ppm.

Iron impurities are disadvantageous because iron can also form redox couples which adversely affect current efficiency of the cell. Furthermore, it is desirable to minimize the amount of iron impurities contained in the aluminum produced by the cell. Iron impurity levels in the produced aluminum are preferably maintained below about 0.5 weight percent, typically below about 0.25 or 0.2 weight percent. In a particularly preferred embodiment, the iron impurity level is below about 0.18 or 0.15 weight percent. Copper impurity levels in the produced aluminum are preferably maintained below about 0.2 or 0.1 weight percent, more preferably below about 0.04 or 0.03 weight percent. Nickel impurity levels in the produced aluminum are preferably maintained below about 0.2 or 0.1 weight percent, more preferably below about 0.03 weight percent. The produced aluminum also preferably meets the following weight percentage standards for other types of impurities: 0.2 maximum Si; 0.03 maximum Zn; and 0.03 maximum Co.

Individually, sulfur and iron impurities have been found to significantly reduce the current efficiency of inert anode aluminum production cells. For example, sulfur levels above about 500 ppm in some inert anode cells have been found to reduce the current efficiency of the cells below about 80 percent. The combination of sulfur and iron impurities has been found to be particularly disadvantageous in inert anode cells. The build-up of combined sulfur and iron impurity levels can actually cause aluminum produced during operation of the cell to be removed.

It has been found that during the operation of inert anode cells, the amounts of sulfur and other impurities may initially be within acceptable levels, but may increase to unacceptable levels during continued operation of the cell. In comparison with consumable carbon anode cells which produce COS, inert anode cells have been found to build up sulfur impurities in the bath to levels above 500 ppm, often above 1,000 ppm. FIG. 1 is a graph illustrating the build up of sulfur impurity levels during operation of an aluminum production cell after the consumable carbon anodes of the cell have been replaced with inert anodes. After several days of operation with the inert anodes, the sulfur impurity level increases above 500 ppm.

In accordance with an embodiment of the present invention, impurity reduction zones are provided in aluminum production cells. FIGS. 2–5 illustrate embodiments in which reduction zones are created through the use of at least one purifying electrode positioned in the bath.

Figure 2:
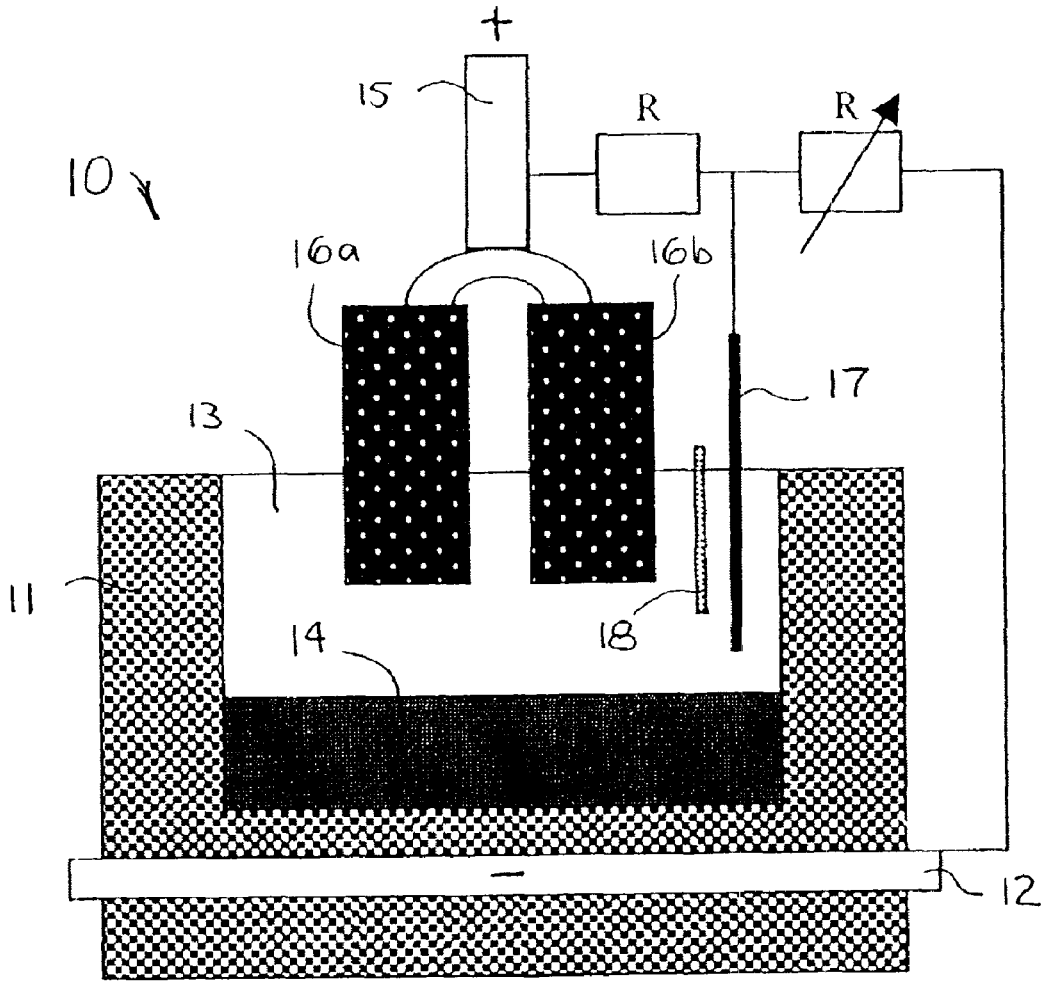
FIG. 2 is a partially schematic side sectional view of an aluminum smelting cell including an anodic purifying electrode which utilizes the power supply of the cell in accordance with an embodiment of the present invention.

FIG. 2 is a partially schematic side sectional view of an aluminum smelting cell 10 in accordance with an embodiment of the present invention. The cell 10 includes a refractory wall 11 and a cathode 12. During operation, the cell 10 is partially filled with a molten electrolytic bath 13 which is contained by the refractory wall 11. During the aluminum production process, a molten pad of aluminum 14 forms at the bottom of the cell 10. An anode assembly 15 includes anodes 16*a* and 16*b* which are partially submerged in the bath 13. The anodes 16*a* and 16*b* are positioned above the level of the cathode 12 in the embodiment shown in FIG. 2. However, other anode/cathode configurations known in the art may be used in accordance with the present invention in which at least a portion of the anode(s) are positioned at the same level as the cathode(s). With these configurations, sulfur impurities tend to build up in the bath 13 without contacting the aluminum pad 14 that is formed at the bottom of the cell 10. The anodes 16*a* and 16*b* preferably comprise inert anodes, for example, as disclosed in U.S. Pat. Nos. 6,162,334, 6,217,739, 6,332,969, 6,372,119, 6,416,649, 6,423,195 and 6,423,204. A purifying electrode 17 is partially submerged in the bath 13. The purifying electrode 17 may be made of any suitable material such as carbon, graphite, $TiB_2$, W, Mo, carbon steel or stainless steel.

In the embodiment shown in FIG. 2, the purifying electrode 17 is connected to the power supply of the cell 10. An oxygen barrier 18 is provided in the bath 13 between the anode 16*b* and the purifying electrode 17. The oxygen barrier 18 may be made of any suitable material such as $TiB_2$, BN or ferrites. During anodic operation of the cell 10, current supplied to the purifying electrode 17 creates a positive potential of sulfur, such that sulfur species are oxidized, e.g., to gaseous phases such as COS and $S0_2$. The cell 10 is typically a commercial scale cell operated above 50,000 Amps for the commercial production of aluminum.

Figure 3:
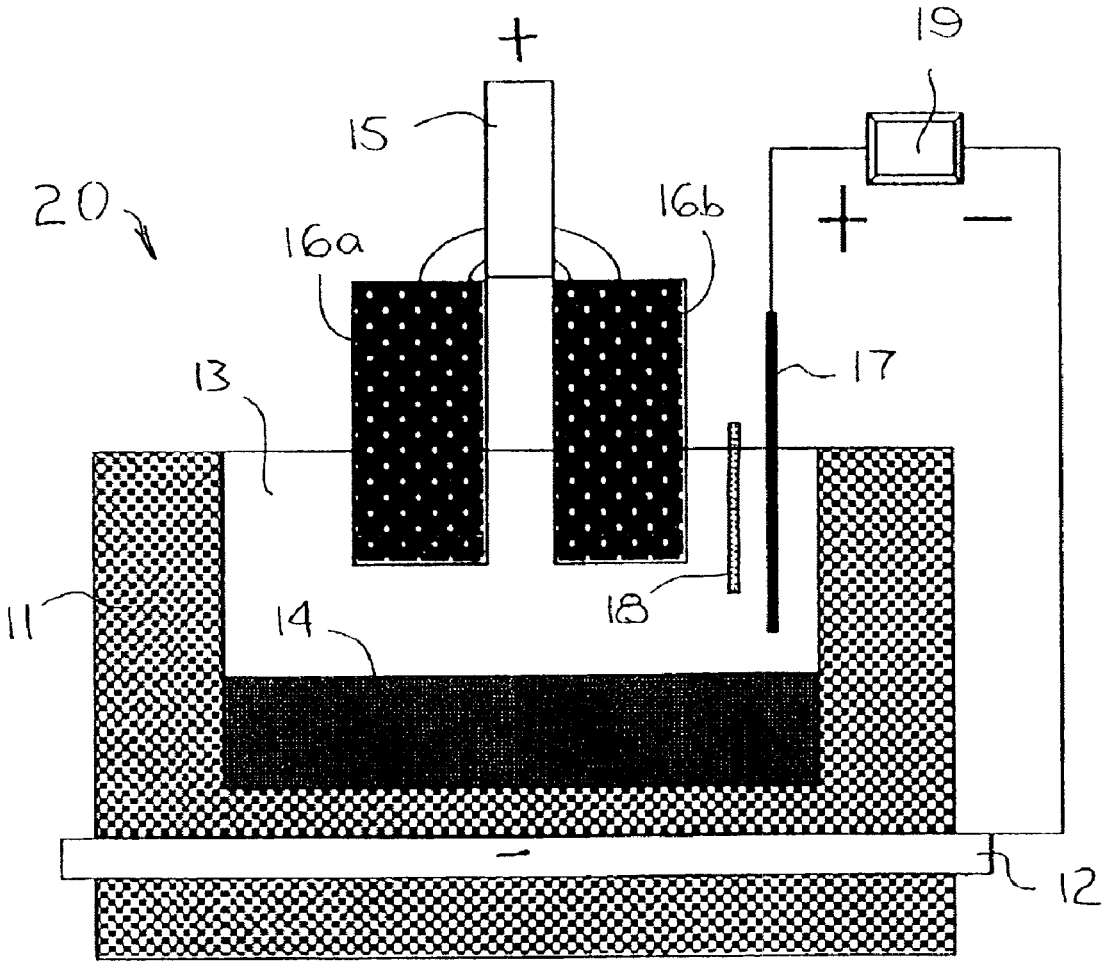
FIG. 3 is a partially schematic side sectional view of an aluminum smelting cell including an anodic purifying electrode which utilizes a separate power supply in accordance with an embodiment of the present invention.

FIG. 3 is a partially schematic side sectional view of an aluminum smelting cell 20 in accordance with another embodiment of the present invention. The cell 20 is similar to the cell 10 shown in FIG. 2, with the exception that the purifying electrode 17 is connected to a separate power supply 19.

Figure 4:
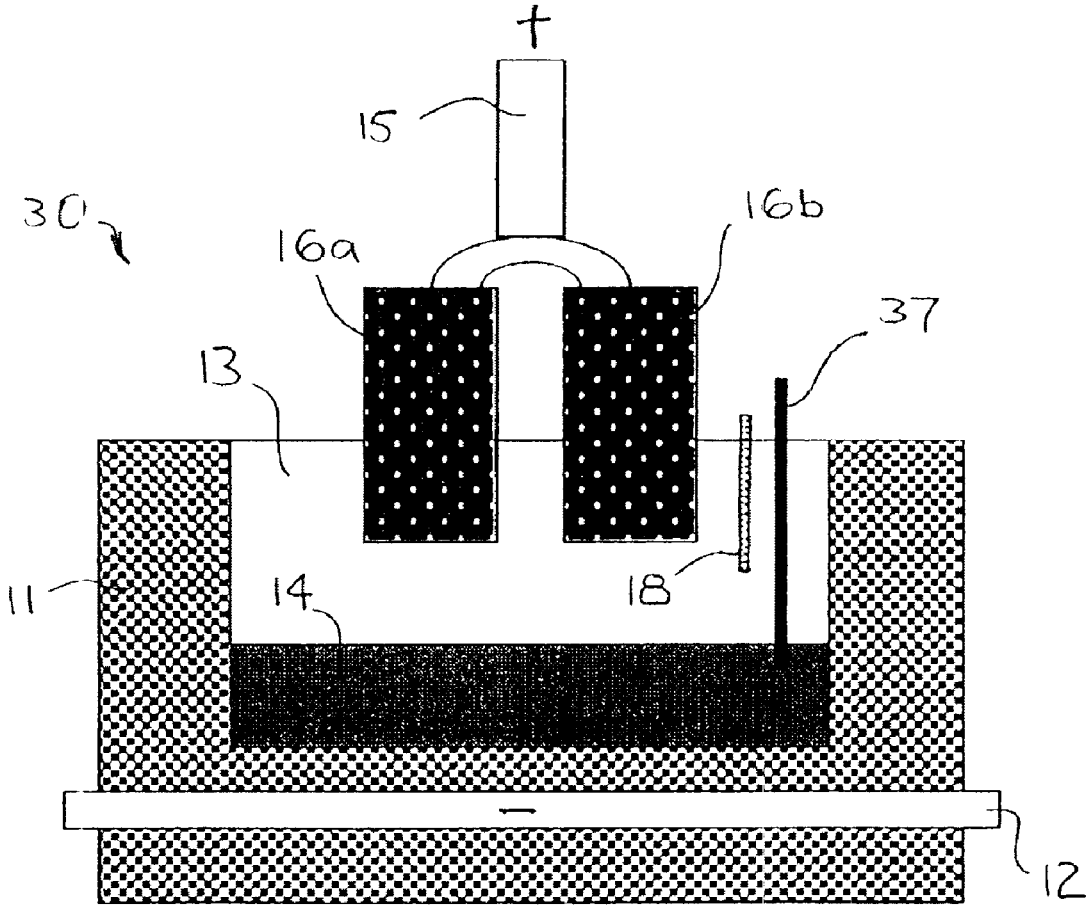
FIG. 4 is a partially schematic side sectional view of an aluminum smelting cell including a cathodic purifying electrode with an interior cathode connection in accordance with an embodiment of the present invention.

FIG. 4 is a partially schematic side sectional view of an aluminum smelting cell 30 in accordance with a further embodiment of the present invention. The cell 30 is similar to the cell 10 shown in FIG. 2, except the cell 30 includes a purifying electrode 37 which operates in a cathodic mode through its contact with the molten aluminum pad 14 which, in turn, is electrically connected to the cathode 12. The purifying electrode 37 operates at a negative potential of sulfur, such that sulfur species are reduced, e.g., to elemental S or gaseous $S_2$.

Figure 5:
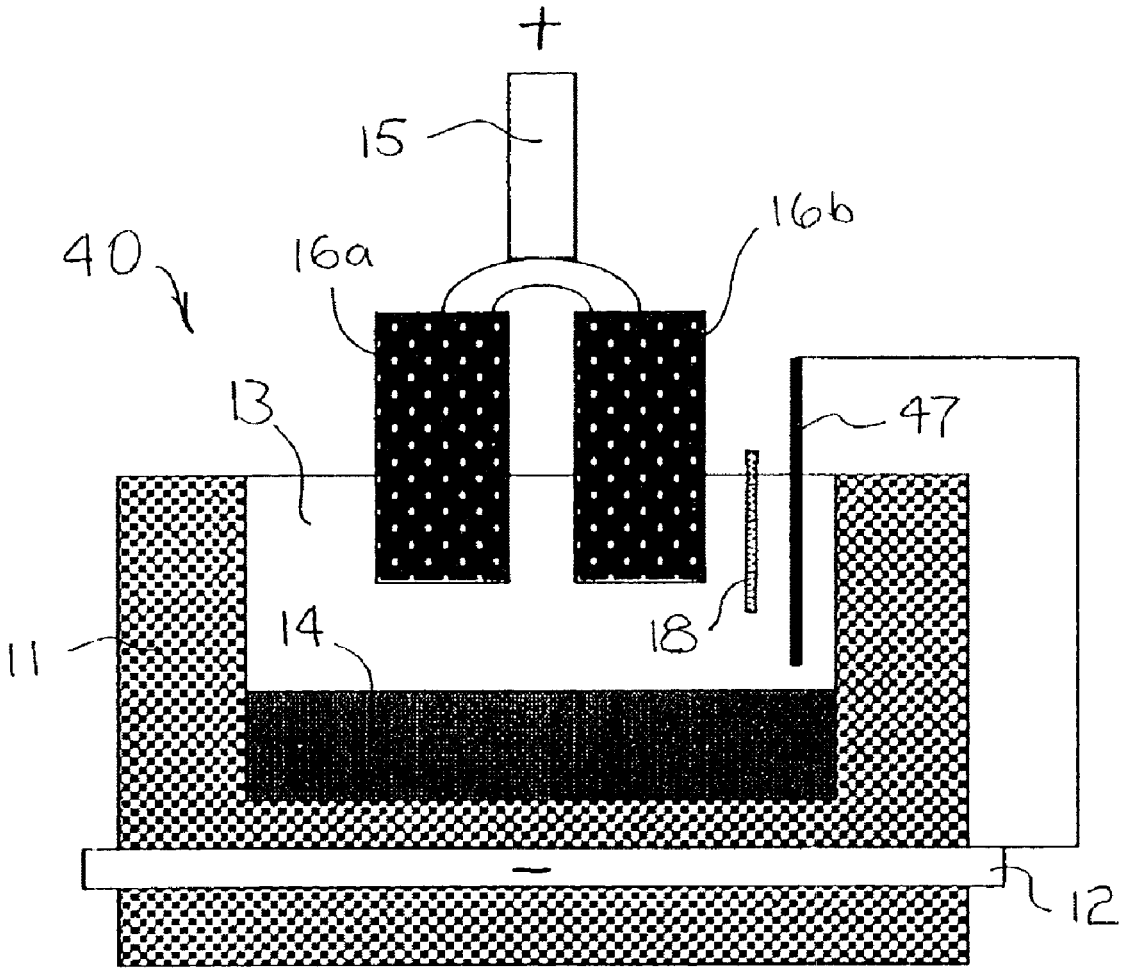
FIG. 5 is a partially schematic side sectional view of an aluminum smelting cell including a cathodic purifying electrode with an exterior cathode connection in accordance with an embodiment of the present invention.

FIG. 5 is a partially schematic side sectional view of an aluminum smelting cell 40 in accordance with another embodiment of the present invention. The cell 40 is similar to the cell 30 shown in FIG. 4, except it includes a purifying electrode 47 that is externally connected to the cathode 12.

Figure 6:
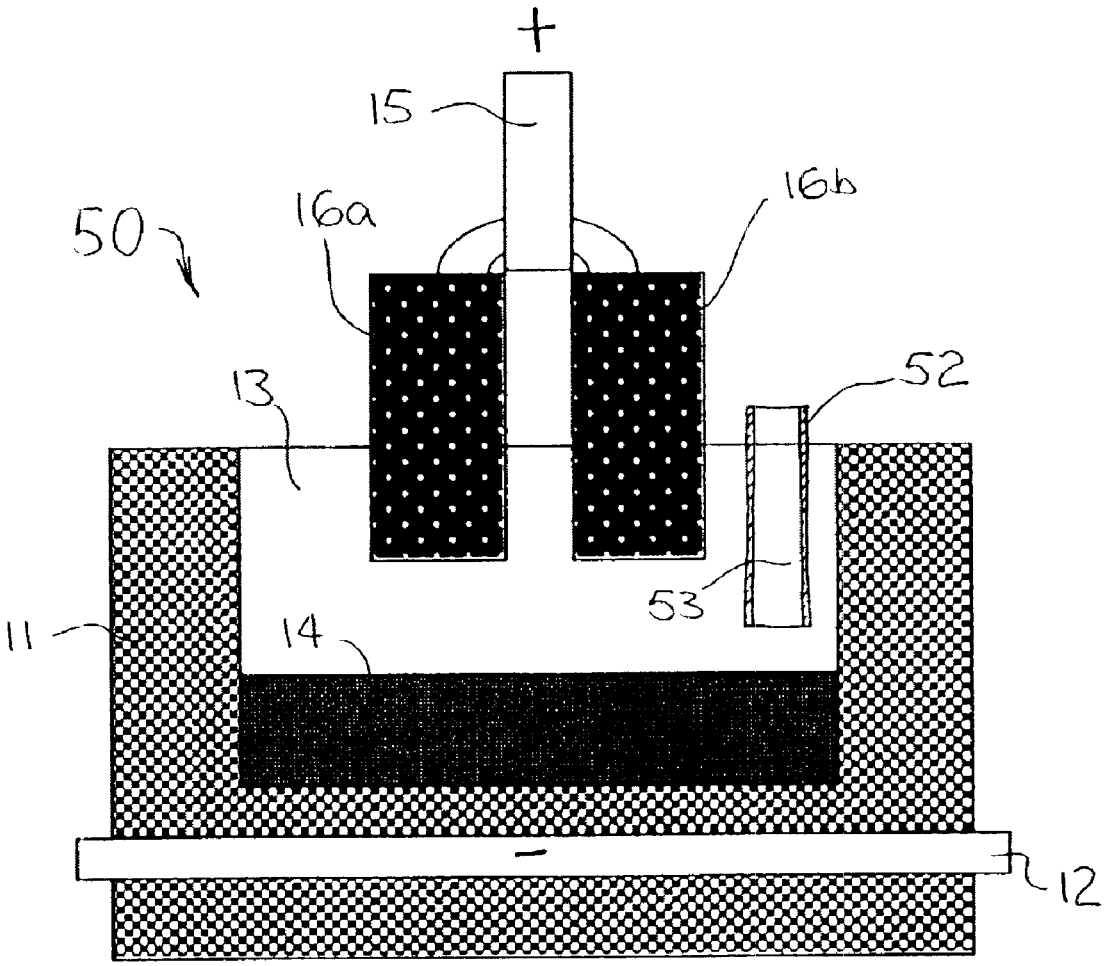
FIG. 6 is a partially schematic side sectional view of an aluminum smelting cell including an oxygen barrier tube submerged in the electrolytic bath in accordance with a further embodiment of the present invention.

FIG. 6 is a partially schematic side sectional view of an aluminum smelting cell 50 in accordance with a further embodiment of the present invention. The cell 50 is similar to the cell 10 shown in FIG. 2, except the cell 50 does not include a purifying electrode and is provided with an oxygen barrier tube 52 partially submerged in the bath 13. The oxygen barrier tube 52 may be made of any suitable material such as alumina, $TiB_2$, BN or ferrites. The interior 53 of the oxygen barrier tube 52 contains a portion of the bath 13 which is isolated from gaseous species generated at the interface between the anodes 16*a* and 16*b* and the bath 13. For example, when the anodes 16*a* and 16*b* comprise inert anodes, oxygen generated at the anode/bath interface is prevented from entering the interior 53 of the barrier tube 52. This substantially oxygen-free zone allows sulfur-containing species such as $SO_2$ to vent from the bath 13 through the barrier tube 52 rather than creating unwanted oxygen-containing reaction products in the bath 13.

Figure 7:
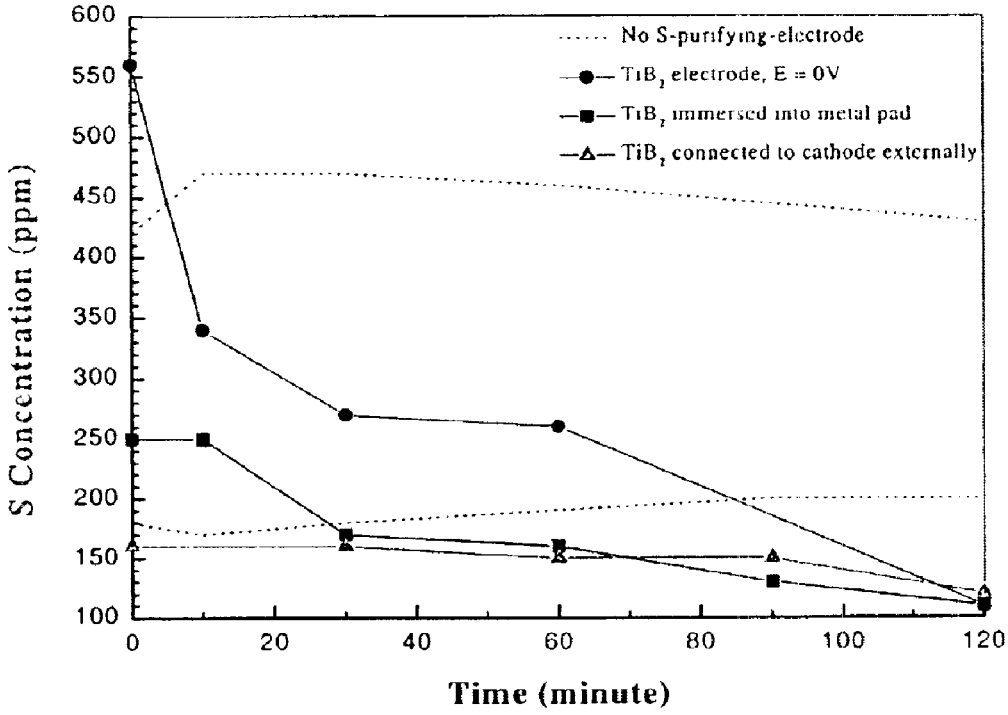
FIG. 7 is a graph of sulfur impurity concentration versus operation time of an inert anode aluminum production cell incorporating a purifying electrode in accordance with an embodiment of the present invention.

FIG. 7 is a graph of sulfur concentration versus operation time of bench scale aluminum production cells operated with a single inert anode. In FIG. 7, the dashed lines represent tests performed with no purifying electrodes, while the solid lines represent tests performed with $TiB_2$ purifying electrodes. The dashed lines in FIG. 7 show sulfur levels in the test cell operated without a purifying electrode, after doping with 200 ppm sulfur (lower dashed line) then doping with 300 ppm sulfur (upper dashed line). Doping was done using $Na_2SO_3$. The same results were achieved using $Na_2SO$ as the dopant. The sulfur concentration remained substantially constant or slightly increased in these cells operated without a purifying electrode The round points in FIG. 7 are from a test cell similar to those illustrated in FIGS. 2 and 3 incororating a $TiB_2$ purifying electrode which was maintained at an electrode potential of E=0 V relative to the aluminum potential. In this cell, the sulfur concentration decreased from an initial level of about 560 ppm to about 110 ppm within 2 hours. The square points in FIG. 7 are from a test cell similar to that shown in FIG. 4 with a $TiB_2$ purifying electrode immersed into the metal pad. In this cell, the sulfur concentration decreased from about 250 ppm to about 110 ppm within 2 hours. The triangular points in FIG. 7 are from a test cell similar to that shown in FIG. 5 in which a $TiB_2$ purifying electrode was externally connected to the cathode. In this cell, the sulfur impurity level decreased from about 160 ppm to about 120 ppm in 2 hours.

Figure 8:
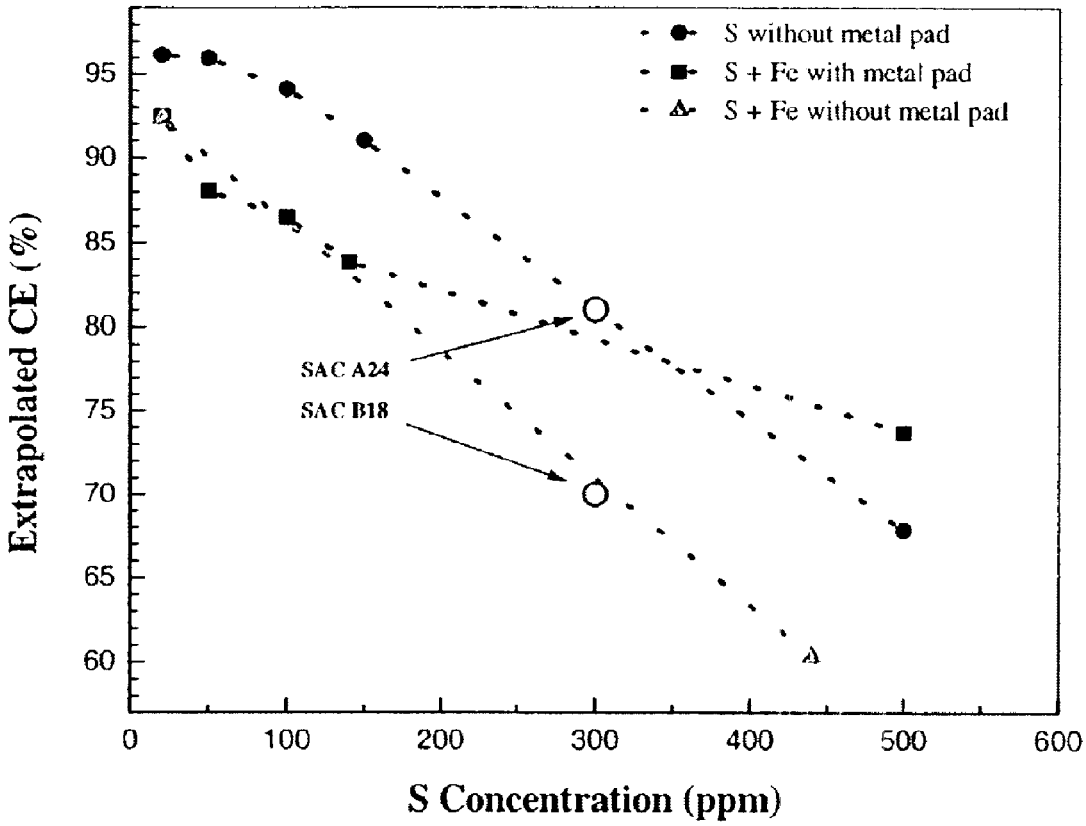
FIG. 8 is a graph of current efficiency versus sulfur impurity concentration within an electrolytic bath, showing substantially reduced current efficiencies at higher sulfur impurity levels.

An electrochemical test was conducted to determine the affect of sulfur impurity concentrations on the current efficiency of a test cell comprising an inert anode. The test was conducted by setting up an electrolytic cell using commercial Hall-bath and a cermet inert anode, adding different concentrations of S as sulfide/sulfate into the bath, and using standard cyclic voltammetry and chronopotentiometry methods to determine the effect of S concentration in the bath on current efficiency. FIG. 8 is a graph of current efficiency versus sulfur concentration in the bath, demonstrating significant decreases in current efficiencies as the sulfur impurity levels increase. At sulfur concentrations above 500 ppm, the current efficiency of the cell decreases below 70 percent.

Figure 9:
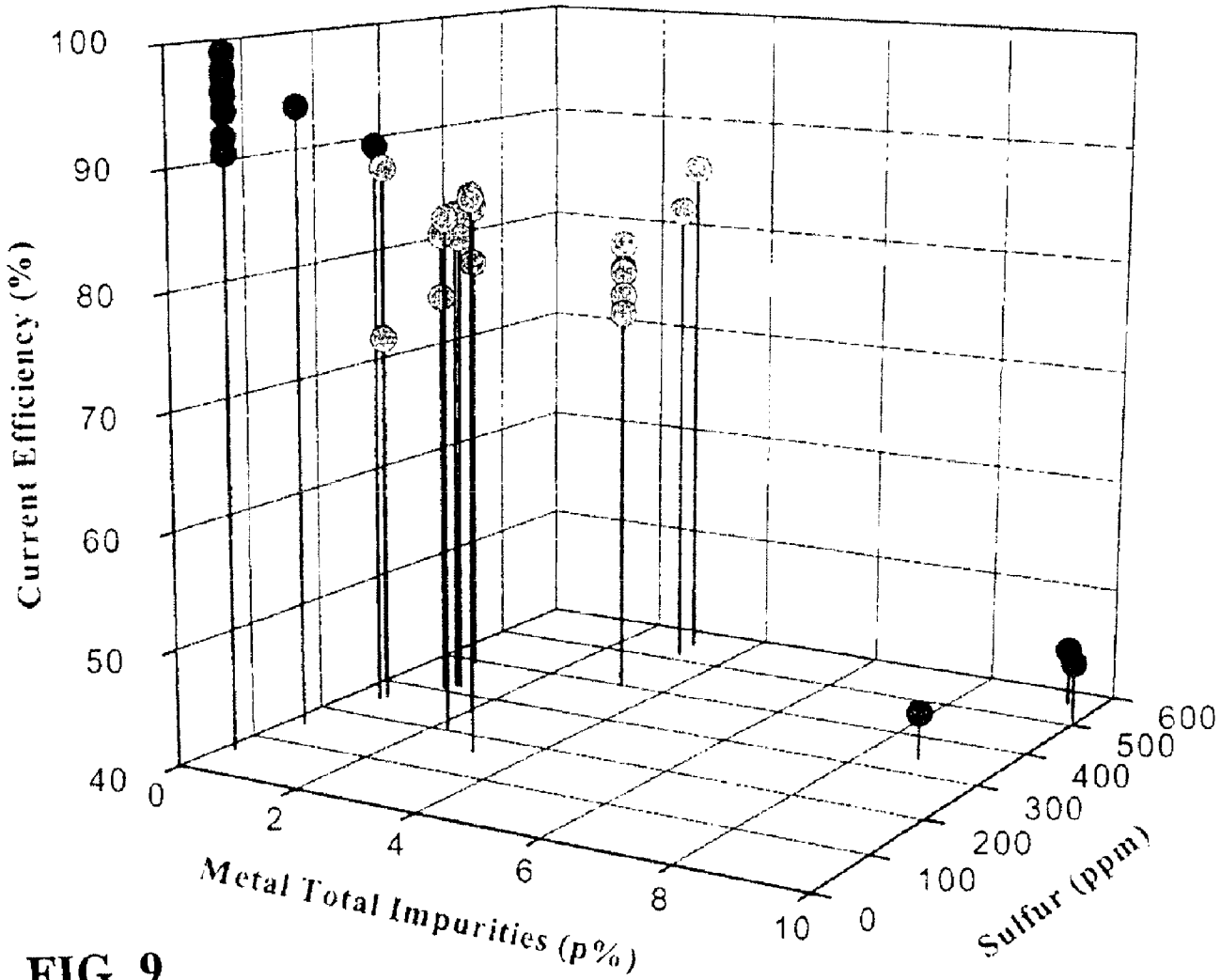
FIG. 9 is a graph of current efficiency versus sulfur impurity concentration within an electrolytic bath and total impurity levels in the produced aluminum, demonstrating substantially reduced current efficiencies at higher sulfur impurity levels and higher aluminum impurity levels.

FIG. 9 is a graph showing current efficiency versus sulfur impurity levels in a bath and total impurity levels in the produced aluminum. A test was performed to determine the influence of sulfur on current efficiency at a relatively large scale. An electrochemical cell including one inert anode and was operated at 950 Amperes. Initially the electrolyte was low in sulfur and the contaminates in the aluminum produced by the cell were at low levels. Since the alumina is decomposed to oxygen and aluminum, oxygen evolution from the cell was used to determine the current efficiency of the cell. Aluminum contaminants such as iron, nickel and copper were added to the cell to determine their effect on current efficiency. FIG. 9 is a summary of the results of this test. At low sulfur levels in the electrolytic bath and low aluminum impurities, the current efficiency was above 90 percent. As sulfur and contaminants were added the current efficient initially fell below 80 percent, then 70 percent, and eventually dropped to less than 50 percent. As shown in FIG. 9, current efficiency is substantially decreased by sulfur impurities in the bath and impurities contained in the aluminum produced by the cell.

Figure 10B:
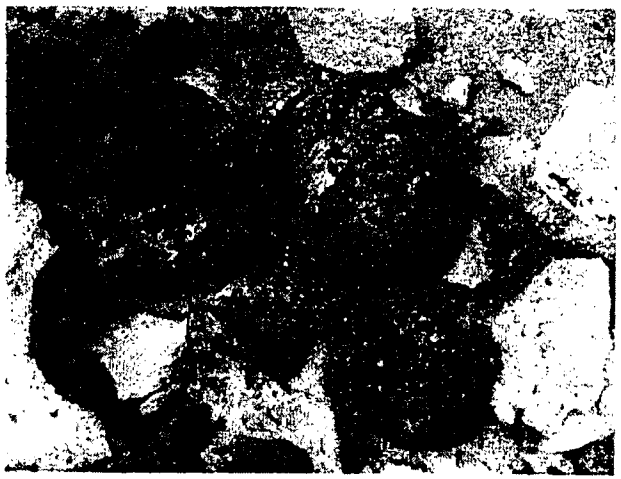
FIGS. 10*a*–10*d* are photographs of solidified baths.
Figure 10D:
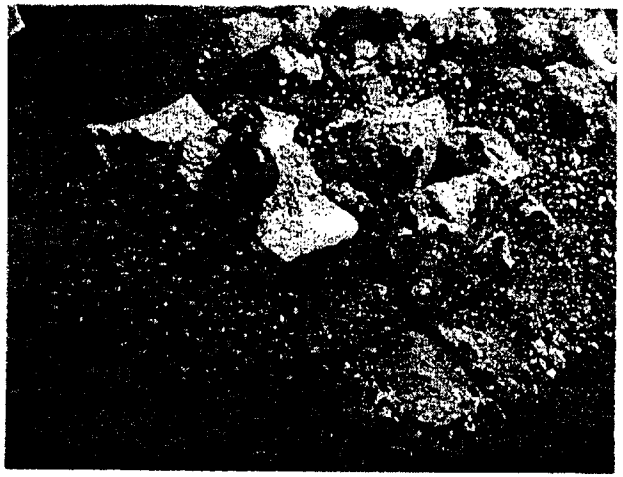
Figure 10A:
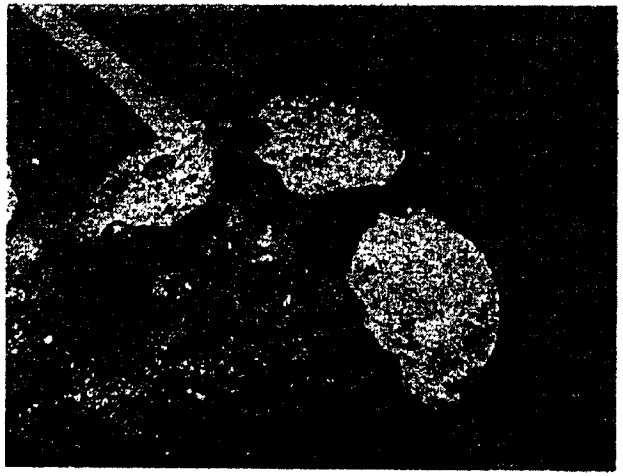
Figure 10C:
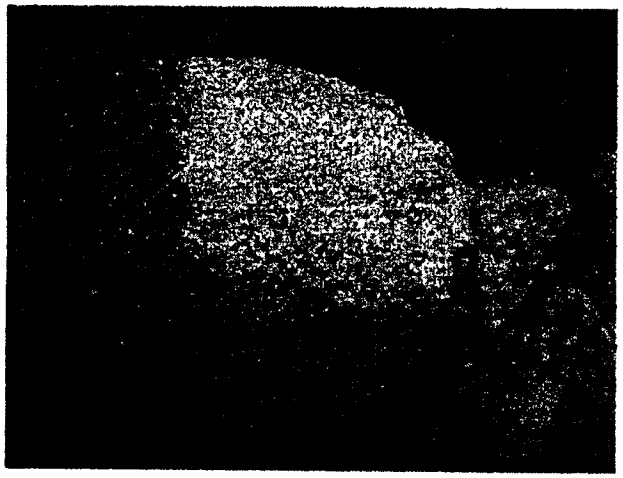

After running a test in an inert anode cell at 4 amp/cm$^2$ for 30 mins, 500 ppm of S as $Na_2SO_3$ was added to the bath. The metal at the end of the test was not coalesced. Several aluminum spheres were present in the solidified bath, and a few aluminum spheres were seen in the solidified bath. Photographs of uncoalesced aluminum spheres are provided in FIGS. 10*b*–10*d*. For comparison purposes, a photograph of solidified bath having a coalesced aluminum pad from a cell having a minimal sulfur impurity level is shown in FIG. 10*a*.

In accordance with another embodiment of the present invention, the impurity reduction zone is created through all or a portion of the bath by adding or controlling the distribution of reductants such as Al, $Na_2CO_3$, $CaCO_3$, $Li_2CO_3$, $MgCO_3$, CO and $CO_2$. When Al is used to reduce impurities, it may be added in the form of recirculated aluminum produced by the cell, or the aluminum may be added as pellets, rods or slabs. The aluminum reductant may be continuously or intermittently added to the bath. Gaseous reductants such as CO and $CO_2$ may be added to the bath by means such as standard sparging techniques.

In accordance with a further embodiment of the present invention, electric current flow may be interrupted through some or all of the electrodes of a cell in order to allow impurities to escape from the cell in gaseous forms. For example, electrode current may be interrupted to some or all of the inert anodes of a cell in order to allow sulfur-containing gas such as sulfur dioxide to escape from the bath. Alternatively, selected regions of the cell may not include anodes in order to provide a region or regions within the cell where oxygen generation is reduced or eliminated.

The various embodiments for producing impurity reduction zones as described herein may be combined. For example, when an oxygen barrier tube as show in FIG. 6 is used, a purifying electrode such as shown in FIGS. 2–5 may be positioned within the tube. Alternatively, purifying reductants such as aluminum may be introduced into the bath through such an oxygen barrier tube, with or without the additional use of a purifying electrode.

In accordance with another embodiment of the present invention, sulfur contained in gaseous emissions from inert anode cells is removed by scrubbing techniques. During inert anode cell operations, the hot gases emitted from the cell may be recovered and used to heat the incoming alumina feed by passing the hot gases over the alumina. When sulfur and other impurities contained in the gaseous emissions contact the alumina, they are absorbed and carried back to the cell by the incoming alumina. Scrubbing removes sulfur in the off-gas flow, e.g., by electrostatic or chemical (wet or dry scrubbing) means. Electrostatic techniques use electrically charged plates or electrostatic precipitators, which attract the charged sulfur species. The surface is periodically cleaned to remove deposited sulfur species. Wet scrubbing means injecting water or a chemical solution into the exhaust gases. Dry scrubbing uses materials having high surface areas, such as active carbon or lime, which react with the gases.

Sulfur removal may be achieved by passing the gaseous emissions through a bed of reactive material such as activated carbon or the like. Adsorption of $SO_2$ onto activated carbon occurs in two steps. In the first step $SO_2$ is catalytically oxidized on the carbon to $SO_3$. Then the $SO_3$ hydrolyzes in the presence of water vapor to form sulfuric acid, which condenses in the pores of the carbon:

$$SO_2 + 1/2\,O_2 \xrightarrow[\text{carbon}]{} SO_3$$

$$SO_3 + H_2O \longrightarrow H_2SO_4 \text{ (condensed).}$$

Figure 11:
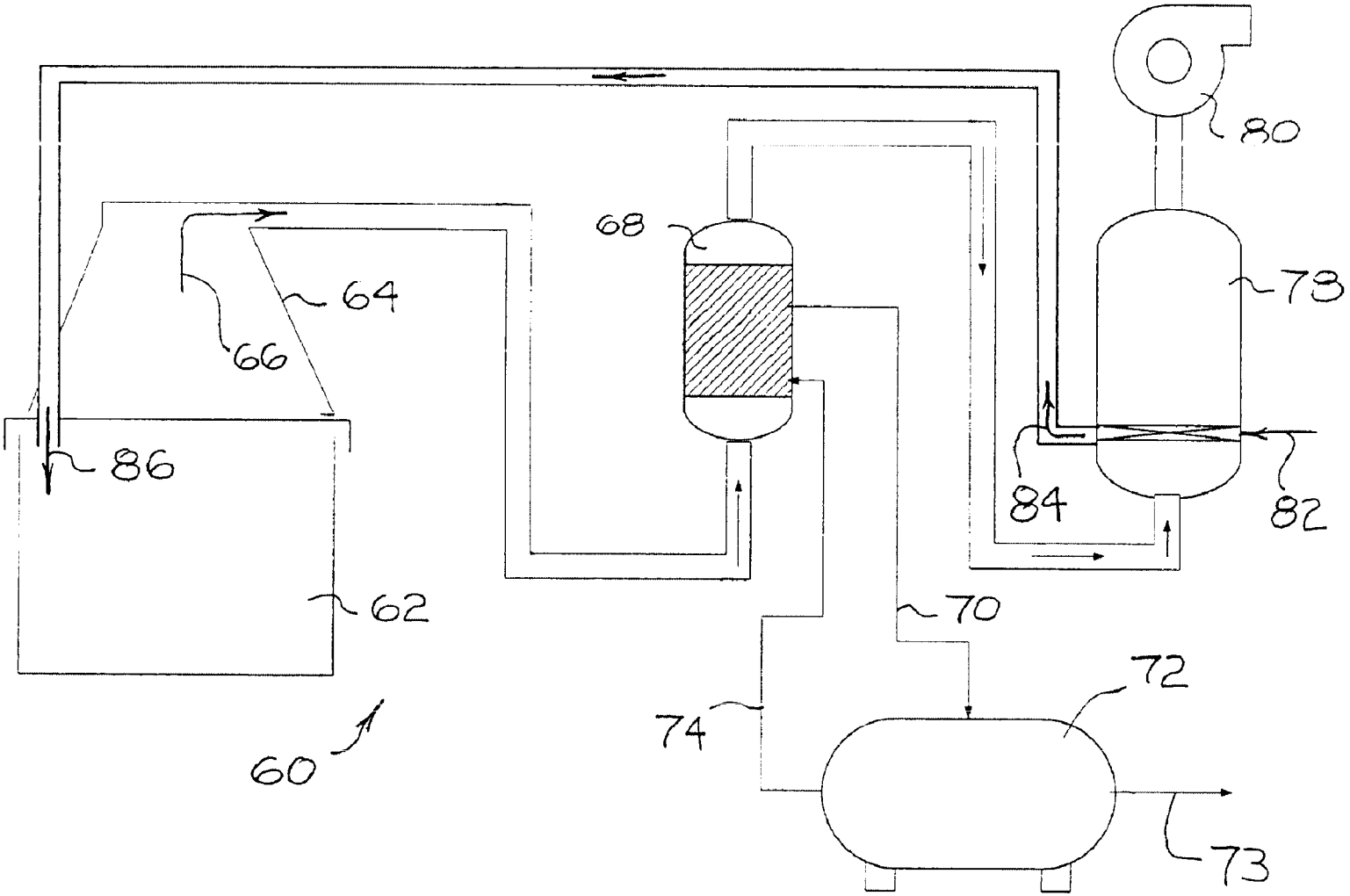
FIG. 11 is a partially schematic diagram of a bath emission scrubber system in accordance with an embodiment of the present invention.

FIG. 11 is a schematic diagram of a sulfur scrubbing system 60 including a cell 62 equipped with a hood 64. Pot gases 66 comprising oxygen, sulfur-containing species such as $SO_2$ and fluorides flow from the cell 62 to an activated carbon bed 68 where the $SO_2$ and other sulfur-containing species are removed. Carbon and sulfuric acid 70 from the activated carbon bed 68 are treated in a regeneration chamber 72, and regenerated carbon 74 is reintroduced into the activated carbon bed 68. The activated carbon can be regenerated by treatment with water in the regeneration chamber 72 to form an effluent 73 such as dilute acid or chemicals such as gypsum. Oxygen and fluoride gases 76 exit the activated carbon bed 68 and pass through a dry alumina scrubber 78 to remove fluoride values so they can be returned to the cell 62, thereby recycling the fluoride values and minimizing fluoride emissions to the atmosphere. Gases from the scrubber 78 are vented 80 to atmosphere. Alumina 82 is fed to the dry scrubber 78. As described in more detail below, the alumina 82 may comprise various sulfur impurity contents. After the alumina 82 is contacted with the oxygen and fluoride gases 76 in the dry scrubber 78, the alumina and absorbed fluorides 84 are recycled 86 to the cell 62. It is important that the $SO_2$ scrubbing in the activated carbon bed 68 does not remove a significant amount of the fluoride from the pot gases 66 so the maximum amount of fluorides can be recycled to the cell 62 via contact with the alumina 82 in the dry scrubber 78.

In addition ot the system 60 shown in FIG. 11, alternative scrubbing or stripping systems that may be used in accordance with the present invention include other types of reactive beds such as lime beds, aqueous leaching systems, electrostatic precipitators, and the like.

Figure 12:
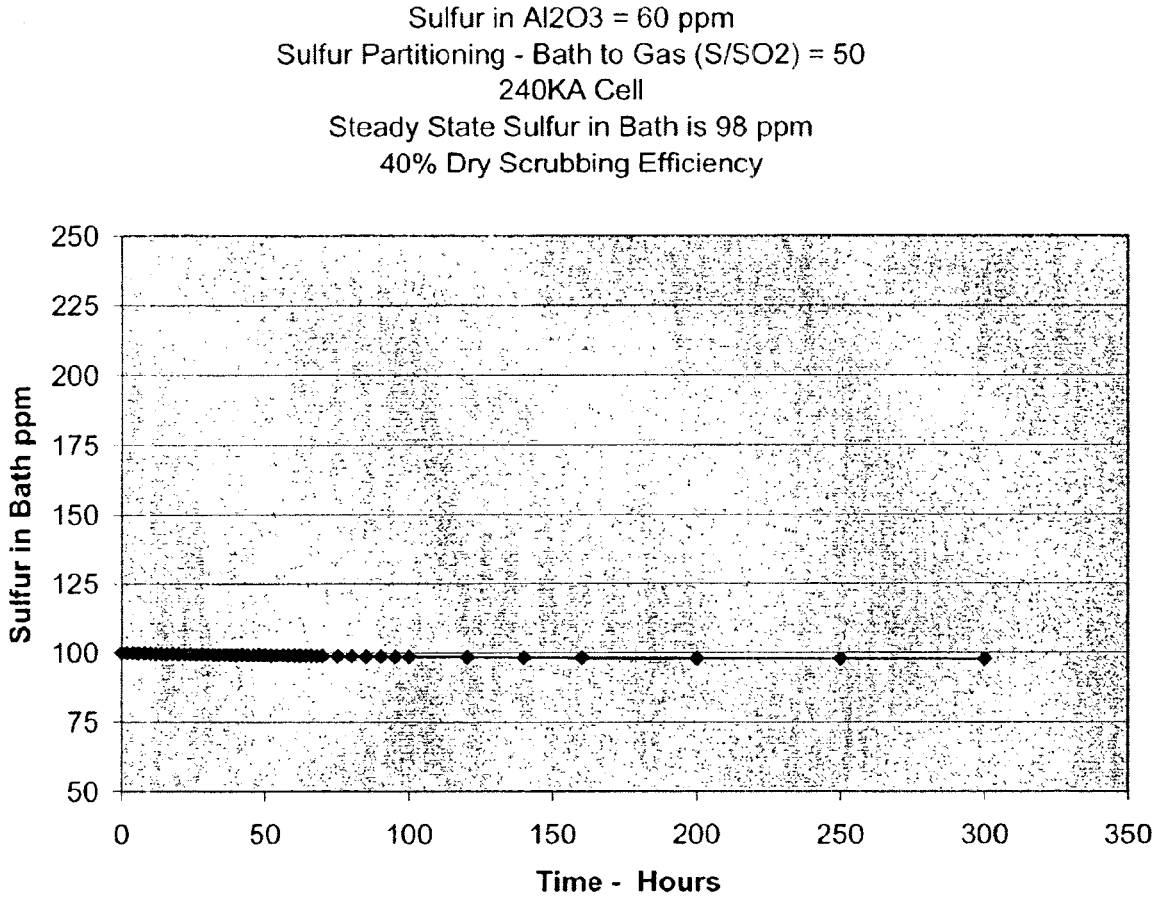
FIGS. 12–17 are graphs of sulfur impurity concentrations in electrolytic baths versus cell operation times, illustrating mass balance calculations for cells operated with varying sulfur impurity levels in the alumina feed, cells operated with and without a purifying electrode, and cells operated with and without activated carbon $SO_2$ scrubbers.
Figure 13:
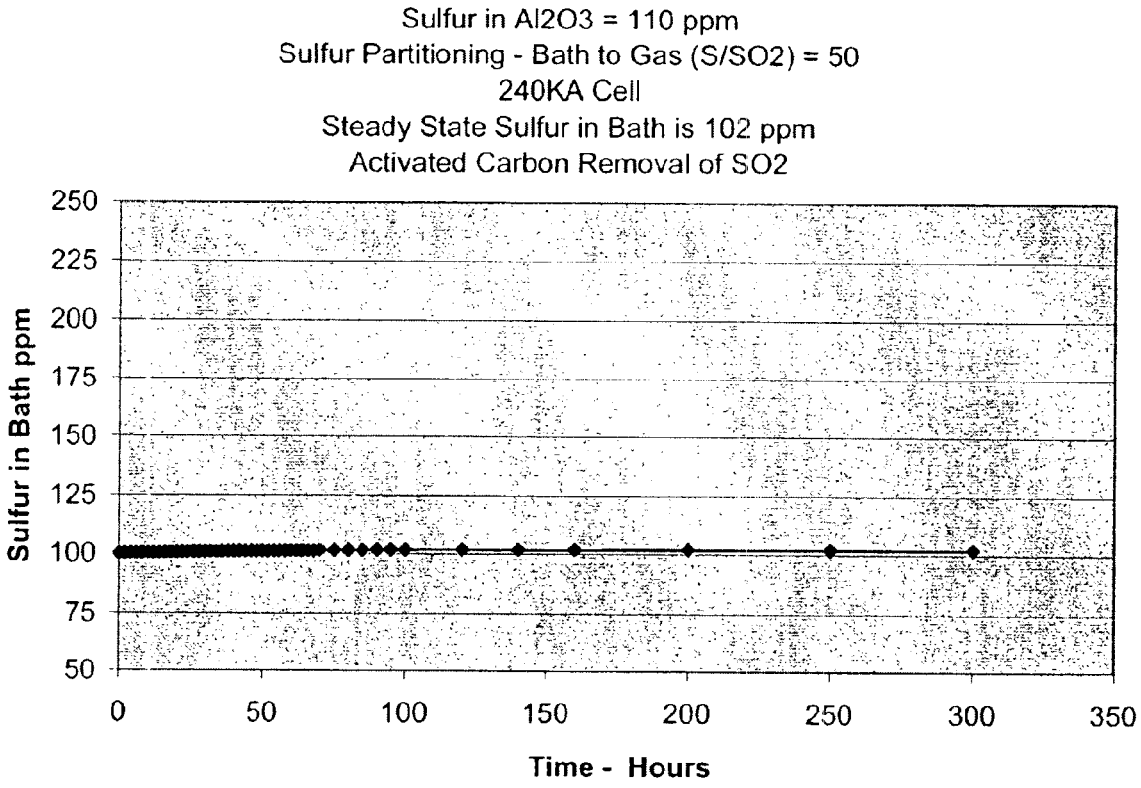
Figure 14:
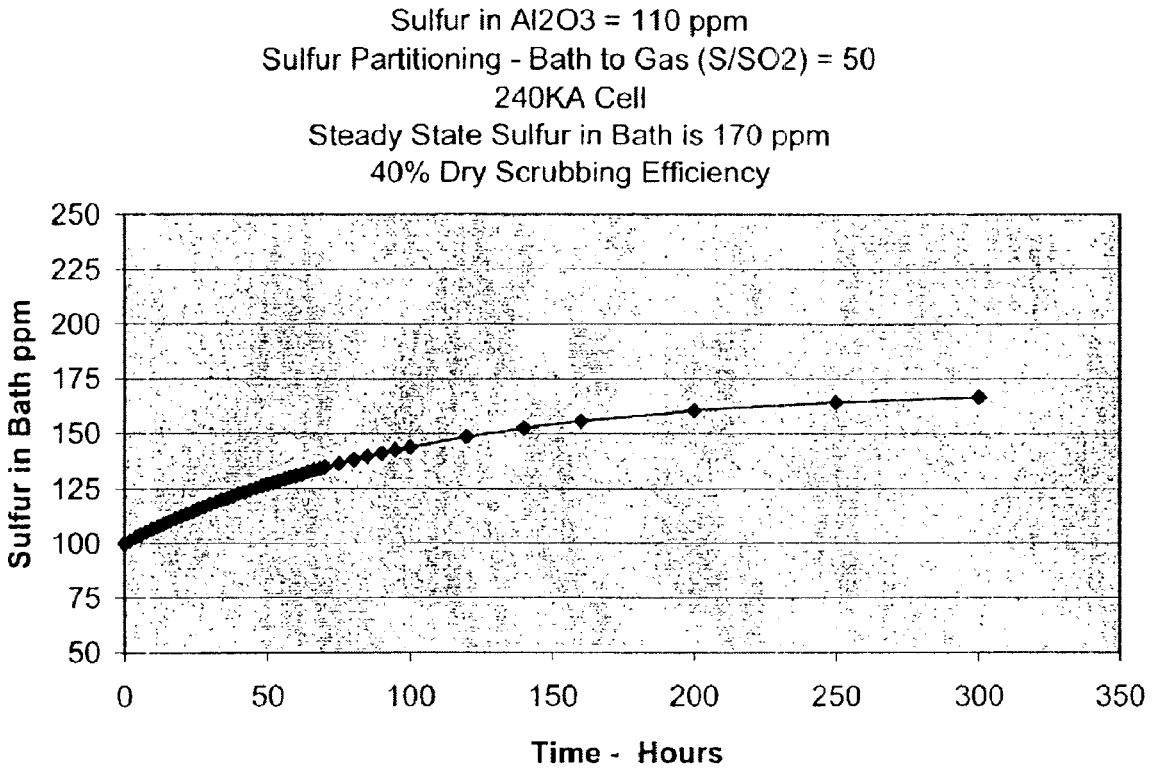
Figure 15:
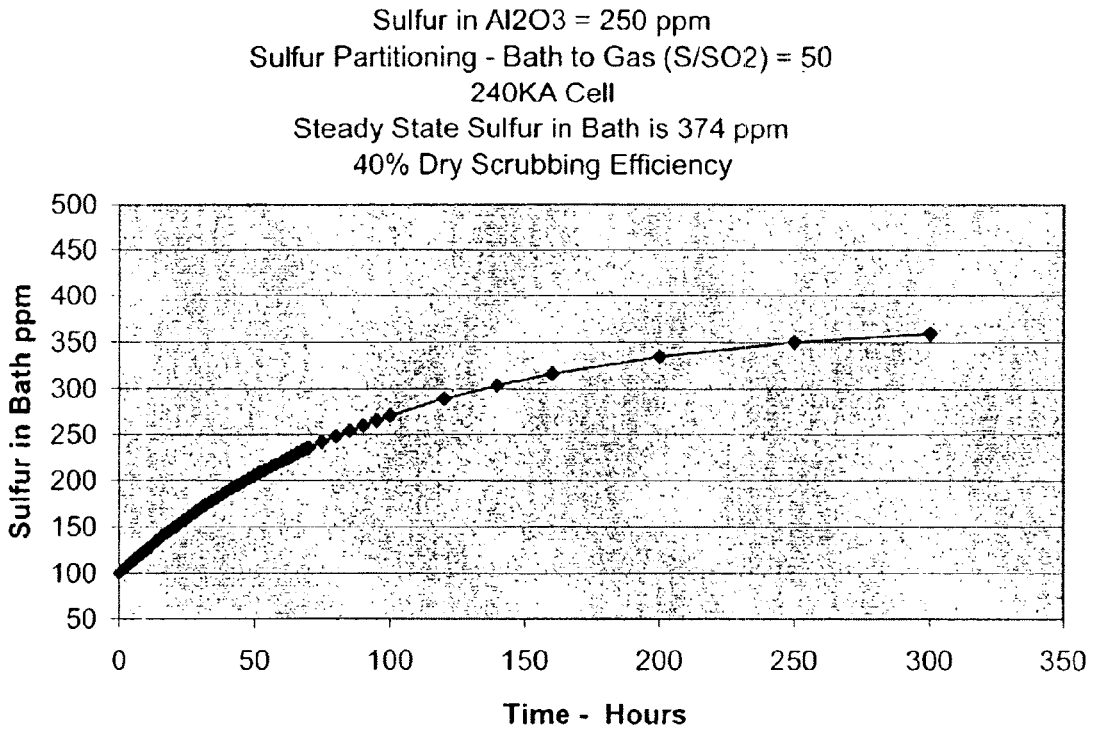
Figure 16:
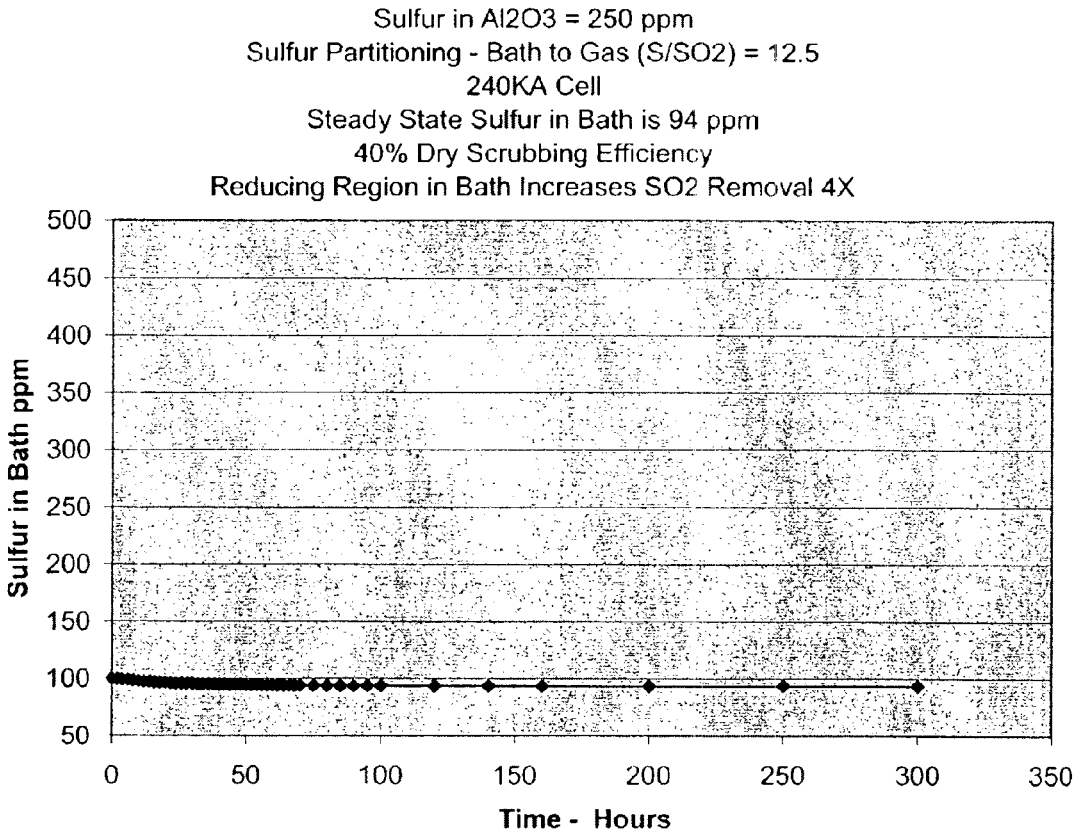
Figure 17:
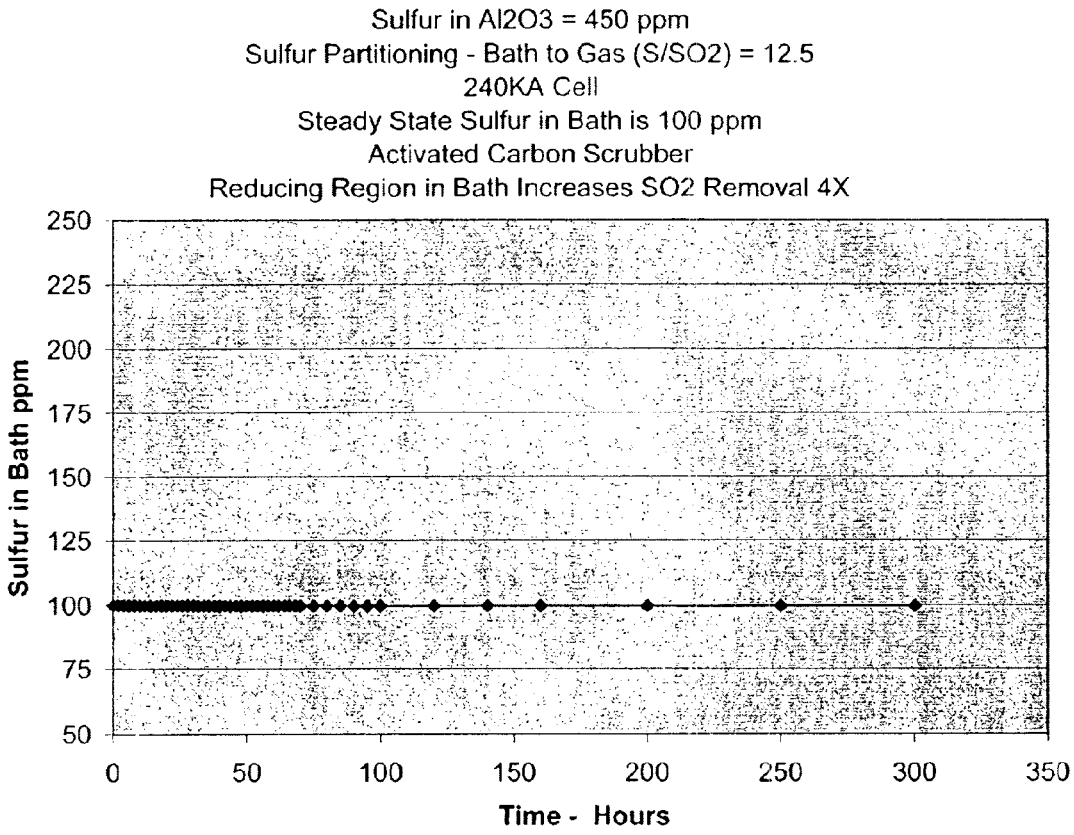

In accordance with a further embodiment of the present invention, the sulfur content of various materials introduced into the bath is controlled. FIGS. 12–17 illustrate, through mass balance calculations, the influence on the steady state concentration of sulfur in the cell of the following parameters: the use of cleaner raw materials; scrubbing $SO_2$ from the pot gas to reduce recycle back to the cell; and providing an impurity reduction zone in the cell. FIG. 12 shows that with a sulfur content in the alumina fed to the cell of 60 ppm, and considering 40 percent efficient dry scrubbing, the steady state sulfur in the bath would be under 100 ppm. As shown in FIG. 13, with 110 ppm sulfur in the alumina, the use of an activate carbon bed also can achieve 102 ppm sulfur in the bath. As shown in FIG. 14, with 110 ppm sulfur in the alumina and without the activated carbon bed, the sulfur increases to 170 ppm. Increasing the sulfur in the alumina to 250 increases the sulfur in the bath to 374 ppm, as shown in FIG. 15. The use of an impurity reducing zone in the cell would increase the $SO_2$ removal four-fold, allowing the use of 250 ppm sulfur alumina while achieving a sulfur level in the bath of less than 100 ppm, as shown in FIG. 16. The combination of an impurity reducing zone in the cell with activated carbon scrubbing can permit the use of alumina containing as much as 450 ppm while still achieving a sulfur level in the bath of 100 ppm, as shown in FIG. 17.

In accordance with an embodiment of the present invention, the sulfur content of alumina may be selected within various ranges while maintaining acceptable sulfur impurity levels in the bath. For example, low-sulfur alumina having a sulfur content within a range of from about 40 to about 100 ppm may be used with no additional sulfur-reducing steps, or with minimal additional sulfur-reducing techniques. Medium-sulfur alumina having a sulfur content within a range of from about 100 to about 250 ppm may be used with selected sulfur-reducing techniques of the present invention necessary to achieve the desired sulfur concentration in the bath. High-sulfur alumina having a sulfur content of from about 250 to about 600 ppm or higher may be used in combination with the present sulfur-reducing techniques in order to maintain the desired sulfur concentration in the bath.

Having described the presently preferred embodiments, it is to be understood that the invention may be otherwise embodied within the scope of the appended claims.

What is claimed is:

1. A method of operating an inert anode electrolytic aluminum production cell to maintain a low sulfur impurity concentration, the method comprising providing a cell comprising a molten electrolytic bath comprising fluoride and alumina, a cathode and at least one inert anode;

passing current between the at least one inert anode and the cathode through the electrolytic bath to produce aluminum;

maintaining a sulfur impurity concentration in the electrolytic bath of less than about 500 ppm, wherein the sulfur impurity concentration is maintained by providing an impurity reduction zone in the electrolytic bath: and recovering aluminum from the cell.

2. The method of claim 1, wherein the sulfur impurity concentration is maintained below about 250 ppm.

3. The method of claim 2, wherein the cell operates at a current efficiency of at least about 80 percent.

4. The method of claim 2, wherein the cell operates at a current efficiency of at least about 90 percent.

5. The method of claim 1, wherein the sulfur impurity concentration is maintained below about 100 ppm.

6. The method of claim 5, wherein the cell operates at a current efficiency of at least about 80 percent.

7. The method of claim 5, wherein the cell operates at a current efficiency of at least about 90 percent.

8. The method of claim 1, wherein the sulfur impurity concentration is maintained during a cell operation period of at least 1 day.

9. The method of claim 1, wherein the sulfur impurity concentration is maintained during a cell operation period of at least 10 days.

10. The method of claim 1, wherein the impurity reduction zone is provided by a purifying electrode at least partially submerged in the electrolytic bath.

11. The method of claim 1, wherein the impurity reduction zone is provided by an oxygen barrier member at least partially submerged in the electrolytic bath.

12. The method of claim 1, wherein the impurity reduction zone is provided by adding a purifying reductant to the electrolytic bath.

13. The method of claim 1, wherein the impurity reduction zone is provided by removing at least one inert anode from a region of the cell.

14. The method of claim 1, wherein the impurity reduction zone is provided by interrupting electrical current through at least one electrode of the cell.

15. The method of claim 1, wherein the sulfur impurity concentration is maintained by controlling sulfur impurities absorbed on alumina added to the electrolytic bath.

16. The method of claim 15, wherein the absorbed sulfur impurities are controlled by scrubbing sulfur impurities from gaseous emissions generated from the electrolytic bath prior to contacting the gaseous emissions with the alumina that is added to the electrolytic bath.

17. The method of claim 16, wherein the sulfur impurities are scrubbed by passing the emissions through a bed of reactive material.

18. The method of claim 17, wherein the bed of reactive material comprises activated carbon.

19. The method of claim 1, wherein the sulfur impurity concentration is maintained by controlling sulfur impurities added to the bath.

20. The method of claim 1, wherein the sulfur impurity concentration is maintained by controlling sulfur content of fluoride and/or alumina added to the bath.

21. The method of claim 20, wherein the sulfur content of the alumina is less than about 100 ppm.

22. The method of claim 20, wherein the sulfur content of the alumina is less than about 250 ppm.

23. The method of claim 22, wherein the sulfur impurity concentration in the bath is maintained below about 100 ppm.

24. The method of claim 20, wherein the sulfur content of the alumina is greater than about 250 ppm.

25. The method of claim 24, wherein the sulfur impurity concentration in the bath is maintained below about 250 ppm.

26. The method of claim 24, wherein the sulfur impurity concentration in the bath is maintained below about 100 ppm.

27. The method of claim 1, wherein aluminum produced by the cell has maximum impurity levels of about 0.5 weight percent iron, about 0.2 weight percent copper and about 0.2 weight percent nickel.

28. A method of reducing sulfur impurities in an inert anode electrolytic aluminum production cell, the method comprising providing an impurity reduction zone within an electrolytic bath of the cell, and producing and recovering aluminum from the cell, wherein aluminum produced by the cell has an iron impurity level of less than about 0.5 weight percent.

29. The method of claim 28, wherein the impurity reduction zone is provided by a purifying electrode at least partially submerged in the electrolytic bath.

30. The method of claim 29, wherein the purifying electrode is anodic.

31. The method of claim 29, wherein the purifying electrode is cathodic.

32. The method of claim 29, wherein the purifying electrode comprises carbon, graphite, $TiB_2$, W, Mo, carbon steel or stainless steel.

33. The method of claim 28, wherein the impurity reduction zone is provided by an oxygen barrier member at least partially submerged in the electrolytic bath.

34. The method of claim 33, wherein the oxygen barrier member comprises a tube partially submerged in the electrolytic bath and extending above a surface of the electrolytic bath.

35. The method of claim 28, wherein the impurity reduction zone is provided by adding a purifying reductant to the electrolytic bath.

36. The method of claim 35, wherein the purifying reductant comprises Al.

37. The method of claim 35, wherein the purifying reductant comprises CO and/or $CO_2$.

38. The method of claim 35, wherein the purifying reductant is introduced into the electrolytic bath continuously during operation of the cell.

39. The method of claim 28, wherein the impurity reduction zone is provided by removing at least one inert anode from a region of the cell.

40. The method of claim 28, wherein the impurity reduction zone is provided by interrupting electrical current through at least one electrode of the cell in order to allow gaseous impurities to escape from the cell.

41. The method of claim 28, wherein the sulfur impurity is present in the electrolytic bath in the form of sulfur ions.

42. The method of claim 28, wherein the sulfur impurity level in the electrolytic bath is maintained below about 500 ppm.

43. The method of claim 28, wherein the sulfur impurity level in the electrolytic bath is maintained below about 250 ppm.

44. The method of claim 28, wherein the sulfur impurity level in the electrolytic bath is maintained below about 100 ppm.

45. The method of claim 44, wherein alumina added to the bath has a sulfur content of less than 100 ppm.

46. The method of claim 44, wherein alumina added to the bath has a sulfur content of from about 100 to about 250 ppm.

47. The method of claim 44, wherein alumina added to the bath has a sulfur content of greater than about 250 ppm.

48. The method of claim 28, wherein aluminum produced by the cell has maximum impurity levels of about 0.5 weight percent iron, about 0.2 weight percent copper and about 0.2 weight percent nickel.

49. The method of claim 28, wherein aluminum produced by the cell has maximum impurity levels of about 0.25 weight percent iron, about 0.1 weight percent copper and about 0.1 weight percent nickel.

50. The method of claim 28, wherein the cell operates at a current efficiency of at least about 80 percent.

51. The method of claim 28, wherein the cell operates at a current efficiency of at least about 90 percent.

52. The method of claim 28, wherein the inert anodes comprise a cermet composite material.

53. The method of claim 28, wherein the cell comprises a cathode and at least one inert anode located at or above a level of the cathode.

* * * * *